United States Patent [19]

Mochizuki

[11] 4,025,184

[45] May 24, 1977

[54] DEVELOPING ELECTRODE CONTAMINATION PREVENTION SYSTEM FOR ELECTROPHOTOGRAPHY

[75] Inventor: Manabu Mochizuki, Tokyo, Japan

[73] Assignee: Ricoh Co., Ltd., Tokyo, Japan

[22] Filed: Aug. 5, 1975

[21] Appl. No.: 602,059

[30] Foreign Application Priority Data

Aug. 14, 1974 Japan ..... 49-92997
Aug. 29, 1974 Japan ..... 49-9169

[52] U.S. Cl. ..... 355/10; 118/7; 118/DIG. 23; 355/14; 427/17

[51] Int. Cl.[2] ..... G03G 15/10

[58] Field of Search ..... 355/10, 17, 3 DD, 14; 118/637, DIG. 23, 7; 427/17

[56] References Cited

UNITED STATES PATENTS 3,892,481 7/1975 Shaefer et al. ..... 355/10

*Primary Examiner*—Richard L. Moses
*Attorney, Agent, or Firm*—Frank J. Jordan

[57] ABSTRACT

A photoconductive drum has an image portion and a non-image portion. A biasing voltage is applied to a developing electrode when the image portion of the drum is adjacent thereto. The developing electrode is grounded when the non-image portion of the drum is adjacent thereto to prevent toner particles from being attracted thereto to accumulate and contaminate the developing electrode. A low voltage is applied to the non-image portion of the drum to remove toner from the developing electrode which was attracted thereto during development of the image portion of the drum.

19 Claims, 2 Drawing Figures

DEVELOPING ELECTRODE CONTAMINATION PREVENTION SYSTEM FOR ELECTROPHOTOGRAPHY

Figure 1:
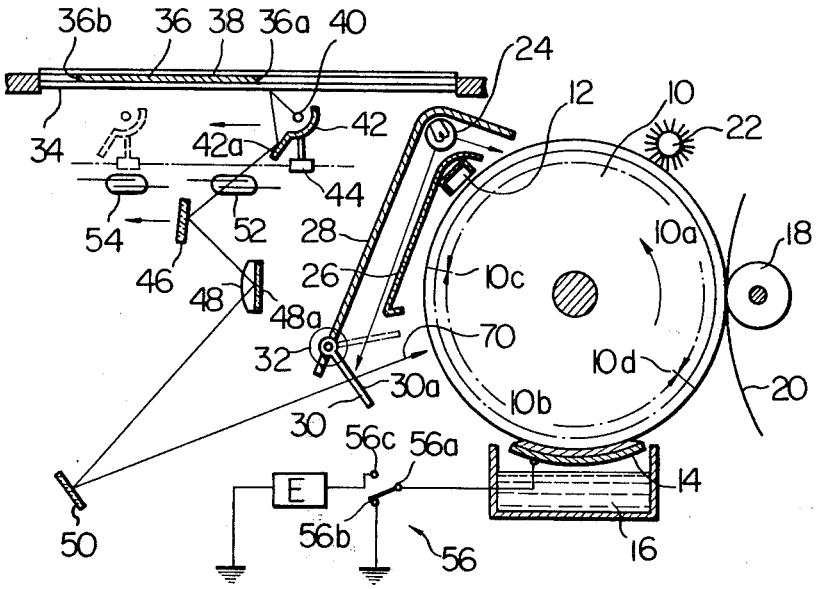

The present invention relates to a process and apparatus for preventing the contamination of a developing electrode of an electrophotographic device.

In electrophotographic apparatus utilizing wet development in which a liquid developing solution contains toner particles, it is common practice to provide a developing electrode adjacent to a photoconductive member such as a drum. The developing electrode serves various purposes including reducing edge effects, adjusting the image density and preventing smearing of the background areas of the copy sheets. In the function of preventing smearing of background areas, the developing electrode is biased to a voltage slightly higher than the voltage of the background areas of the electrostatic image on the drum. The toner particles are thereby attracted to the developing electrode rather than to the drum. The biasing voltage may be increased as the drum becomes old, the optical system deteriorates and the like to maintain the background areas clean.

Since the toner particles have a polarity opposite to that of the charge on the drum, the biasing voltage on the developing electrode must be of the same polarity as the charge on the drum. In a practical electrophotographic device, not all of the area of the drum is used for imaging, and therefore the drum has a non-image area. If the non-image area is not charged, toner particles will be attracted to the developing electrode during the time when the non-image area of the drum is adjacent to the developing electrode. These toner particles will tend to accumulate on the developing electrode and contaminate or foul the same. As a result, the charge of the toner particles will partially neutralize the charge on the developing electrode so that the effective biasing voltage of the developing electrode is lowered below the voltage of the background areas of the drum. This will result in smearing of the background areas since toner particles will be attracted thereto.

A prior art method to remove accumulated toner particles from the developing electrode is to apply a voltage to the developing electrode of the same polarity as the toner particles when the non-image area of the drum is adjacent to the developing electrode. This will force the toner particles away from the developing electrode due to electrostatic repulsion. However, unless this voltage is applied to the developing electrode at all times except when the image area of the drum is adjacent to the developing electrode toner particles will be attracted to the developing electrode to contaminate the same.

In another prior art method, the non-image area of the drum is charged to a voltage higher than the bias voltage applied to the developing electrode to attract the accumulated toner particles from the developing electrode. It has been found in practice that the charge voltage of the non-image area must be quite high in order to effectively remove toner particles from the developing electrode. This high voltage also attracts a large number of the free toner particles suspended in the developing liquid to the photoconductive drum. A cleaning unit is provided to remove all of the toner particles from the drum after the developing step including the accumulated toner particles removed from the developing electrode and the free toner particles attracted from the developing liquid. This method is disadvantageous in that a large amount of toner particles is removed from the liquid developer during the operation of removing accumulated toner particles from the developing electrode, thereby constituting a waste of toner. Toner once used in a developing step is generally unsuitable for reuse, although small amounts may be recycled from the cleaning unit without noticeable deterioration in the image quality of the copies. In the prior art method presently being described, however, the recycled amount of toner becomes excessive and furthermore causes errors in optical measurement of the toner concentration.

It is therefore an important object of the present invention to provide a process for maintaining a developing electrode of an electrophotographic device free from contamination by toner particles which overcomes all of the above described drawbacks of the prior art.

It is another object of the present invention to provide apparatus embodying the above method.

It is another object of the invention to provide a process for preventing toner particles from being attracted to a developing electrode when a non-image portion of a photoconductive drum is adjacent to the developing electrode.

It is another object of the present invention to provide a process to maintain a developing electrode free from contamination which comprises grounding the developing electrode when a non-image portion of a photoconductive drum is adjacent thereto.

It is another object of the present invention to provide a process to maintain a developing electrode free from contamination which comprises charging a non-image area of a photoconductive drum to a voltage which is substantially equal to the voltage of a background area of an image area of the drum and simultaneously grounding the developing electrode so that toner particles are removed from the developing electrode.

Figure 2:
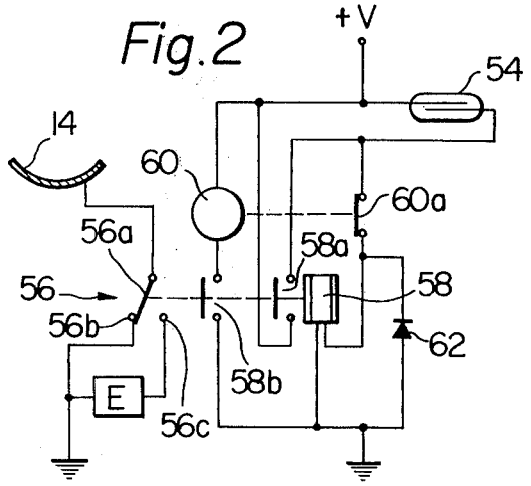

The above and other objects, features and advantages of the present invention will become clear from the following detailed description taken with the accompanying drawings, in which:

FIG. 1 is a schematic view of an electrophotographic device including apparatus for maintaining a developing electrode free from contamination which is an embodiment of the present invention; and FIG. 2 is a schematic diagram of an electrical control system constituting part of the apparatus.

Referring now to FIG. 1, the apparatus comprises a photoconductive drum 10 which has an image area or portion 10*a* and a non-image or auxiliary area or portion 10*b*. The drum 10 is rotatable counterclockwise by drive means (not shown) as designated by an arrow. A corona charging unit 12 is arranged adjacent to the upper portion of the drum 10 and a developing electrode 14 is arranged adjacent to and below the drum 10. Below the developing electrode 14 is a tank 16 filled with a liquid developing solution containing toner particles. The developing electrode 14 further serves as a tray for the developing liquid which is pumped into the space between the developing electrode 14 and drum 10 by a pump (not shown). The bottom of the drum 10 is thereby immersed in the developing liquid on the developing electrode 14. A feed roller 18 is provided to move a copy sheet 20 in pressing contact with the drum 10.

A cleaning brush 22 is arranged to contact the upper portion of the drum 10 and remove residual toner therefrom. The brush 22 may be adapted to return the removed toner to the tank 16 although the ducting is not shown. A light source 24 is provided between the brush 22 and the charging unit 12. The light from the light source 24 is directed onto the drum 10 by baffles 26 and 28. Rotatably mounted to the bottom of the baffle is a shutter 30. The right (as viewed in FIG. 1) surface of the shutter 30 is silvered to constitute a plane mirror 30*a*. A rotary solenoid 32 is electrically actuable to rotate the shutter 30 between the solid and broken line positions as shown.

A transparent platen 34 supports an original document 36 to be electrophotographically copied. A gray cover 38 holds the document 36 in position. An imaging system for projecting a light image of the document 36 onto the drum 10 comprises a light source 40. A reflector 42 is provided for the light source 40 which has a lower silvered portion which constitutes a plane mirror 42*a*. A magnet 44 is fixed to the reflector 42. Light from the mirror 42*a* is reflected from a plane mirror 46, a plane mirror 48*a* and a plane mirror 50 onto the drum 10. A converging lens 48 integral with the mirror 48*a* serves as an objective to focus an image of the document 36 on the drum 10. The reflector 42, light source 40, magnet 44 and mirror 46 are movable left and right as shown in broken line to scan the document 36. A reed switch 52 connected to actuate the rotary solenoid 32 (the circuit is not shown) is located adjacent to a leading edge 36*a* of the document 36 and a reed switch 54 is located between the switch 52 and a trailing edge 36*b* of the document 36.

The developing electrode 14 is connected to a movable contact 56*a* of a switch 56. A fixed contact 56*b* of the switch 56 is grounded. The switch 56 is provided with another fixed contact 56*c* which is connected to a biasing voltage source E. If desired, the biasing voltage source E may be omitted and the developing electrode 14 allowed to be self-biased by the drum 10 as is well known in the art.

Referring now to FIG. 2, a control circuit for the switch 56 comprises the reed switch 54 which is connected in series with normally closed contacts 60*a* of a timer 60 and a relay coil 58 between a voltage source +V and ground. A diode 62 is connected in parallel with the relay coil 58. Normally open holding contacts 58*a* actuated by the relay coil 58 are connected in parallel with the reed switch 54. The timer 60 is connected in series with normally open contacts 58*b* actuated by the relay coil 58 between the voltage source +V and ground. The relay coil 58 also actuates the switch 56 as will be described in detail below. The rotary solenoid 32 is operated by a control circuit (not shown) essentially similar to that shown in FIG. 2 which is actuated by the reed switch 52.

The basic operation of the apparatus is conventional and will now be described. The drum 10 and reflector 42 are synchronizingly driven and the drum 10 is charged by the charging unit 12. Rotary solenoid 32 is actuated so that the shutter 30 is in the broken line position. In this manner light from the source 24 radiates only the upper portion of the drum 10 and is blocked at the lower portion by the shutter 30. The drum 10 and reflector 42 are driven in such a manner that when an image of the leading edge 36*a* of the document 36 is focussed on the drum 10 as shown by an arrow 70 a leading edge 10*c* of the image portion 10*a* of the drum 10 is adjacent to the head of the arrow 70. Further movement of the drum 10 and reflector 42 results in scanning the document 36 in such a manner that when an image of the trailing edge 36*b* of the document 36 is focussed on the drum 10 a trailing edge 10*d* of the image portion 10*a* is adjacent to the head of the arrow 70. The light image causes the drum 10 to conduct in areas of the image portion 10*a* corresponding to light areas (background areas) of the document 36 so as to form an electrostatic image on the image portion 10*a* of the drum 10. The contacts 56*a* and 56*c* of the switch 56 are engaged so that the biasing voltage from the source E is applied to the developing electrode 14 as will be further described below. The image portion 10*a* of the drum 10 passes through the developing liquid on the developing electrode 14 so that toner particles in the liquid are attracted to the drum 10 to form a toner image. The toner image is transferred to the copy sheet 20 by the roller 18 and thermally fixed to the sheet 20 by a fixing unit (not shown). Residual toner on the drum 10 is removed by the brush 22 and the drum 10 is discharged by the light source 24 prior to being recharged for another copying operation by the charging unit 12. It will be noted that the non-image or auxiliary portion 10*b* of the drum 10 is not used in the basic copying operation.

The process for preventing contamination of the developing electrode 14, which constitutes the novelty of the present invention, will now be described. When the reflector 42 reaches the leading edge 36*a* of the document 36, the magnet 44 actuates the reed switch 52 and thereby the rotary solenoid 32 to move the shutter 30 out of the path of the image from the mirror 50 so that the image of the document 36 is focussed on the drum 10. A timer (not shown) controls the rotary solenoid 32 to hold the shutter 30 in the broken line position for a length of time sufficient for the trailing edge 10*d* of the image portion 10*a* of the drum 10 to be moved adjacent to the head of the arrow 70 (the scanning or imaging operation to be completed). The rotary solenoid 32 then moves the shutter 30 to the solid line position so that the mirror 30*a* reflects light from the light source 24 onto the drum 10. The light from the source 24 is thereby radiated onto the non-image or auxiliary portion 10*b* of the drum 10. This light causes the drum 10 to conduct and reduce the voltage on the non-image portion 10*b* of the drum 10 from a high voltage impressed by the charging unit 12 to a voltage which is approximately equal to the voltage of the background areas of the electrostatic image on the image portion 10*a* of the drum 10.

The reed switch 54 is located at a position such that it is closed by the magnet 44 when the leading edge 10*c* of the image area 10*a* of the drum 10 just enters the liquid on the developing electrode 14. This completes a circuit through the contacts 60*a* and the relay coil 58 which energizes the relay coil 58. This closes the holding contacts 58*a* to maintain the relay coil 58 energized after the reed switch 54 is opened. It also closes the contacts 58*b* to actuate the timer 60 and connects the movable contact 56*a* of the switch 56 to the fixed contact 56*c*. The biasing voltage of the source E is thereby applied to the developing electrode 14 through the switch 56. If the source E is omitted, the developing electrode 14 will float (be insulated from ground) and thereby be self-biased by the drum 10.

The timer 60 is set for an interval sufficient for the trailing edge 10*d* of the image portion 10*a* of the drum 10 to just clear the liquid on the developing electrode 14. After the end of this interval the timer 60 momentarily opens the contacts 60*a* to de-energize the relay coil 58. This causes the movable contact 56*a* of the switch 56 to engage with the grounded fixed contact 56*b* to ground the developing electrode 14. The developing electrode 14 remains grounded as long as the non-image portion 10*b* of the drum 10 is adjacent to the developing electrode 14 or until the reed switch 54 is closed again.

Since the developing electrode 14 is grounded, toner particles attracted thereto during the development of the image portion 10*a* of the drum 10 are no longer attracted thereto. These toner particles are, however, attracted to the non-image portion 10*b* of the drum 10 since the non-image portion 10*b* is charged to a voltage which is approximately equal to the voltage of the background areas of the electrostatic image on the image portion 10*a* of the drum 10. These toner particles removed from the developing electrode 14 are removed from the non-image area 10*b* of the drum 10 by the brush 22. In this manner the developing electrode 14 is positively prevented from being contaminated by an accumulation of toner particles.

The biasing voltage on the developing electrode 14, the voltage of the background areas of the electrostatic image on the image portion 10*a* and the voltage on the non-image portion 10*b* of the drum 10 all have the same polarity and a voltage of about 200–300 volts. The toner particles in the developing liquid naturally have the opposite polarity. In a typical practical application the circumference of the image portion 10*a* of the drum 10 is 360mm and the circumference of the non-image portion 10*b* of the drum 10 is 220mm.

Many modifications to the particular exemplary embodiment shown are possible to those skilled in the art after receiving the teachings of the present disclosure. The drum 10 may be replaced by a photoconductive member in the form of an endless belt (not shown) if desired or any other photoconductive member having an image area and a non-image area. It is also possible to eliminate the shutter 30 and provide means for controlling the charging unit 12 to charge the non-image portion 10*b* of the drum 10 to about 200–300 volts while charging the image area 10*a* of the drum 10 to a higher voltage. It is also possible to eliminate the shutter 30 and said means and radiate the non-image portion 10*b* with an image of the gray cover 38.

What is claimed is:

1. In an electrophotographic process in which a photoconductive member having an image portion and a non-image portion is moved relative to a developing electrode, the steps of:

a. applying a bias voltage to the developing electrode when the image portion of the photoconductive member is adjacent to the developing electrode;

b. charging the non-image portion of the photoconductive member to a voltage which is substantially equal to a voltage of a background portion of the image portion of the photoconductive member; and c. grounding the developing electrode when the non-image portion of the photoconductive member is adjacent to the developing electrode.

2. In an electrophotographic process in which a photoconductive member having an image portion and a non-image portion is moved relative to a developing electrode, the steps of:

a. applying a bias voltage to the developing electrode when the image portion of the photoconductive member is adjacent to the developing electrode;

b. charging the non-image portion of the photoconductive member to a voltage which is higher than a voltage of a background portion of the image portion of the photoconductive member;

c. radiating the non-image portion with light to cause the photoconductive member to conduct and reduce the voltage of the non-image portion to the voltage of the background portion of the image portion of the photoconductive member; and d. grounding the developing electrode when the non-image portion of the photoconductive member is adjacent to the developing electrode.

3. In an electrophotographic process in which a photoconductive member having an image portion and a non-image portion is moved relative to a developing electrode, the steps of:

a. electrically insulating the developing electrode from ground so that the developing electrode is self-biased by the photoconductive member;

b. charging the non-image portion of the photoconductive member to a voltage which is substantially equal to a voltage of a background portion of the image portion of the photoconductive member; and c. grounding the developing electrode when the non-image portion of the photoconductive member is adjacent to the developing electrode.

4. In an electrophotographic process in which a photoconductive member having an image portion and a non-image portion is moved relative to a developing electrode, the steps of:

a. electrically insulating the developing electrode from ground so that the developing electrode is self-biased by the photoconductive member;

b. charging the non-image portion of the photoconductive member to a voltage which is higher than a voltage of a background portion of the image portion of the photoconductive member;

c. radiating the non-image portion with light to cause the photoconductive member to conduct and reduce the voltage of the non-image portion to the voltage of the background portion of the image portion of the photoconductive member; and d. grounding the developing electrode when the non-image portion of the photoconductive member is adjacent to the developing electrode.

5. In an electrophotographic apparatus having a photoconductive member with an image portion and a non-image portion and a developing electrode, the photoconductive member being movable relative to the developing electrode, the combination comprising:

first means for electrically biasing the developing electrode when the image portion of the photoconductive member is adjacent to the developing electrode;

second means for charging the non-image portion of the photoconductive member to a voltage which is substantially equal to a voltage of a background portion of the image portion of the photoconductive member; and third means for grounding the developing electrode when the non-image portion of the photoconductive member is adjacent to the developing electrode.

6. The apparatus according to claim 5, further comprising imaging means to radiate a light image on the image portion of the photoconductive member.

7. The apparatus according to claim 5, further comprising control means responsive to the movement of the photoconductive member and connected to control the first and third means.

8. The apparatus according to claim 5, in which the control means comprises a switch which is actuated when a leading edge of the image portion of the photoconductive member is adjacent to the developing electrode and a timer actuated by the switch, the timer being set for a time interval required for a trailing edge of the image portion of the photoconductive member to be moved adjacent to the developing electrode.

9. The apparatus according to claim 8, in which the switch is a reed switch.

10. In a electrophotographic apparatus having a photoconductive member with an image portion and a non-image portion and a developing electrode, the photoconductive member being movable relative to the developing electrode, the combination comprising:

first means for electrically biasing the developing electrode when the image portion of the photoconductive member is adjacent to the developing electrode;

second means for charging the non-image portion of the photoconductive member to a voltage which is higher than a voltage of a background portion of the image portion of the photoconductive member;

third means for radiating the non-image portion with light to cause the photoconductive member to conduct and reduce the voltage of the non-image portion to the voltage of the background portion of the image portion of the photoconductive member; and fourth means for grounding the developing electrode when the non-image portion of the photoconductive member is adjacent to the developing electrode.

11. The apparatus according to claim 10, in which the second means is further operative to charge the image portion of the photoconductive member to the voltage which is higher than the voltage of the background portion of the image portion of the photoconductive member.

12. The apparatus according to claim 11, in which the third means is further operative to radiate light on the image portion of the photoconductive member prior to charging by the second means.

13. The apparatus according to claim 10, further comprising a movable shutter disposed between the third means and the photoconductive member.

14. The apparatus according to claim 10, further comprising imaging means to radiate a light on the image portion of the photoconductive member.

15. The apparatus according to claim 10, further comprising control means responsive to the movement of the photoconductive member and connected to control the first and fourth means.

16. The apparatus according to claim 15, in which the control means comprises a switch which is actuated when a leading edge of the image portion of the photoconductive member is adjacent to the developing electrode and a timer actuated by the switch, the timer being set for a time interval required for a trailing edge of the image portion of the photoconductive member to be moved adjacent to the developing electrode.

17. The apparatus according to claim 16, in which the switch is a reed switch.

18. In an electrophotographic apparatus having a photoconductive member with an image portion and a non-image portion and a developing electrode, the photoconductive member being movable relative to the developing electrode, the combination comprising:

first means for electrically insulating the developing electrode from ground so that the developing electrode is self-biased by the photoconductive member;

second means for charging the non-image portion of the photoconductive member to a voltage which is substantially equal to a voltage of a background portion of the image portion of the photoconductive member; and third means for grounding the developing electrode when the non-image portion of the photoconductive member is adjacent to the developing electrode.

19. In an electrophotographic apparatus having a photoconductive member with an image portion and a non-image portion and a developing electrode, the photoconductive member being movable relative to the developing electrode, the combination comprising:

first means for electrically insulating the developing electrode from ground so that the developing electrode is self-biased by the photoconductive member;

second means for charging the non-image portion of the photoconductive member to a voltage which is higher than a voltage of a background portion of the image portion of the photoconductive member;

third means for radiating the non-image portion with light to cause the photoconductive member to conduct and reduce the voltage of the non-image portion to the voltage of the background portion of the image portion of the photoconductive member; and fourth means for grounding the developing electrode when the non-image portion of the photoconductive member is adjacent to the developing electrode.

* * * * *